US007296508B2

(12) United States Patent
Hillyer

(10) Patent No.: US 7,296,508 B2
(45) Date of Patent: Nov. 20, 2007

(54) SIMPLE INEXPENSIVE HOME CARBONATION DEVICE

(76) Inventor: Robert John Hillyer, 57 West Terrace Place, Spruce Grove (CA) T7X 1T4

( * ) Notice: Subject to any disclaimer, the term of this patent is extended or adjusted under 35 U.S.C. 154(b) by 554 days.

(21) Appl. No.: 10/846,461

(22) Filed: May 17, 2004

(65) Prior Publication Data

US 2005/0252381 A1 Nov. 17, 2005

(51) Int. Cl.
*B01F 3/04* (2006.01)

(52) U.S. Cl. ..... 99/323.2; 99/275; 261/DIG. 7

(58) Field of Classification Search ..... 99/323.2, 99/323.1, 275; 261/DIG. 7; 141/19, 98, 141/329

See application file for complete search history.

(56) References Cited

U.S. PATENT DOCUMENTS 4,423,670 A * 1/1984 Tenison ..... 99/275
4,458,584 A 7/1984 Annese et al. ..... 99/323.1
4,786,519 A * 11/1988 Gupta ..... 426/561
4,940,212 A * 7/1990 Burton ..... 261/64.1
5,366,745 A * 11/1994 Daden ..... 426/477
5,396,934 A * 3/1995 Moench ..... 141/5
6,036,054 A 3/2000 Grill ..... 222/3

* cited by examiner

*Primary Examiner*—Reginald L. Alexander

(57) ABSTRACT

A home carbonation device uses a tube to form a gas-tight seal between two separate existing soda-pop bottles. A threaded cap holds flanges on the tube tight against the opening of each bottle. The liquid to be carbonated is contained in one bottle, while the chemicals for producing carbon dioxide are placed in the second bottle. To keep the chemical reactants from reacting while the gas-tight seal is made, a tall thin cylinder in the second bottle acts as a barrier between reactants until the bottle is placed on its side, at which point the chemicals meet and react producing the carbon dioxide that passes through the tube and carbonates the liquid.

1 Claim, 2 Drawing Sheets

SIMPLE INEXPENSIVE HOME CARBONATION DEVICE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISC APPENDIX

Not Applicable

BACKGROUND OF THE INVENTION

1. Field of Invention

This invention relates to home carbonation devices, especially those that are for simple, inexpensive, small-scale production of carbonated beverages.

2. Description of Prior Art

Current home carbonation techniques include using yeast, dry ice, compressed carbon dioxide, and chemical reactants to obtain the carbon dioxide for carbonating liquids. The current techniques have weaknesses in the area of simplicity and corresponding price, or availability of product, or introduction of undesirable byproducts.

One method for carbonating liquids involves using yeast. In this method, some yeast is added to a sweet sugar-based liquid. The yeast bacteria consume the sugars and produce carbon dioxide as a byproduct. This carbon dioxide production continues for a number of days in a warm environment after which it is to be kept refrigerated. This method is simple, inexpensive, and yeast is fairly easy to come by, but there are several drawbacks to it. First, yeast bacteria need sugar to produce carbon dioxide. This means that one cannot carbonate sugar-free beverages, or water alone. Second, the yeast is placed directly into the beverage to be carbonated. The flavor of the yeast can be unpleasant to taste. Third, yeast bacteria are biological creatures and can be unpredictable. New yeast can be healthy and produce larger amounts of carbon dioxide than old yeast would. Furthermore, yeast thrives better in warm environments, making more carbon dioxide in warm conditions and less in cold conditions. This opposes the fact that carbon dioxide dissolves more readily in cold liquid than in warm. Unexpected variations in temperature or carbon dioxide production times can lead to explosive pressures within the container being used.

Another method for carbonating liquids includes using dry ice as a source of carbon dioxide. In this method, carbon dioxide is in a solid state, and is placed into the liquid to be carbonated. The carbon dioxide sublimates from a solid to gaseous state, and carbonates the liquid. Because the freezing point of carbon dioxide is so low, it will begin the sublimation process under normal atmospheric conditions, even if it is kept in household freezers. This means that one cannot store dry ice at home, and so if it is to be used for carbonation, it will have to be purchased and used on the day of carbonation. The low temperature of dry ice also makes it a hazardous material, introducing the risk of freezing skin. Furthermore, dry ice is not readily available and must be purchased at special outlets. It is inconvenient to use dry ice, because one needs to plan ahead to purchase the dry ice before preparing the beverage. Because of this, the current household method for using dry ice often includes putting the liquid into a large bucket or barrel, and carbonating large quantities of liquid at a time. Making carbonated beverages with dry ice becomes an extensive procedure that exceeds the limits of convenience.

Another source of carbon dioxide used for household carbonation is compressed carbon dioxide. One such design is found in U.S. Pat. No. 6,036,054 issued to Grill Mar. 14, 2000. In this patent, compressed carbon dioxide can be injected into an existing soda-pop bottle, but it involves a valve system which is relatively complicated to manufacture. Systems for injecting compressed carbon dioxide into a liquid are complex. Furthermore, as with dry ice, compressed carbon dioxide is not readily available and must be obtained or recharged at special outlets. Compressed carbon dioxide carbonation systems are relatively complicated and expensive.

Using chemical reactants that produce carbon dioxide is another way to carbonate a beverage. Of the simple devices that use chemical reactants and can be used on a small scale, some do not use common household reactants. These require obtaining the special reactants, or reactants prepared in a special way. There are some that can use common household reactants. U.S. Pat. No. 4,458,584 issued to Annese et al. Jul. 10, 1984 was designed primarily for home use, and used chemical reactants to produce the carbon dioxide. It uses a specially designed container and a sophisticated lid and reaction system that is not as simple or inexpensive to manufacture as it could be.

Home carbonation devices in general can struggle for market success due in part to the low cost and high availability of soda-pop. The convenience and relatively low price of soda-pop often keeps consumers purchasing soda-pop more often than they make it. Carbonating beverages at home usually holds more of a novel advantage rather than an economical or convenient advantage as a replacement source of soda-pop. Because of this, a home carbonation device should be low enough in cost to justify a novel purchase, rather than as a money-saving or time-saving investment.

Despite the many home carbonation techniques found in prior art, they have not succeeded in being simple in design, easy and inexpensive to manufacture, while utilizing a convenient source of carbon dioxide, and preventing unpleasant byproducts from entering the beverage.

BRIEF SUMMARY OF THE INVENTION

The present invention comprises an extremely simple and inexpensive option for carbonating beverages, in which a tube connects the openings of two existing soda-pop bottles. Chemical reactants in one soda-pop bottle produce carbon dioxide that passes through the tube to carbonate the liquid contained in the other soda-pop bottle.

OBJECTS AND ADVANTAGES

Accordingly, several objects and advantages of the present invention are:

(a) to provide a carbonation device that can be simple and inexpensive to manufacture;

(b) to provide a carbonation device that uses readily available chemical reactants to produce the carbon dioxide for carbonation;

(c) to provide a carbonation device that keeps the byproducts of reaction from mixing with the liquid to be carbonated;

(d) to provide a carbonation device that keeps the products of reaction from combining until a gas-tight seal is formed;

(e) to provide a carbonation device that can carbonate water-based liquids, including water, soda-pop, punches, fruit juices, and so forth;

(f) to provide a carbonation device that uses existing soda-pop bottles to allow a convenient familiar container for the carbonated beverage;

Additionally, other advantages of the present invention include its small size, being easy to package, its ease of use, and its novelty by displaying the principle of carbonation in a basic presentation.

Figure 1:
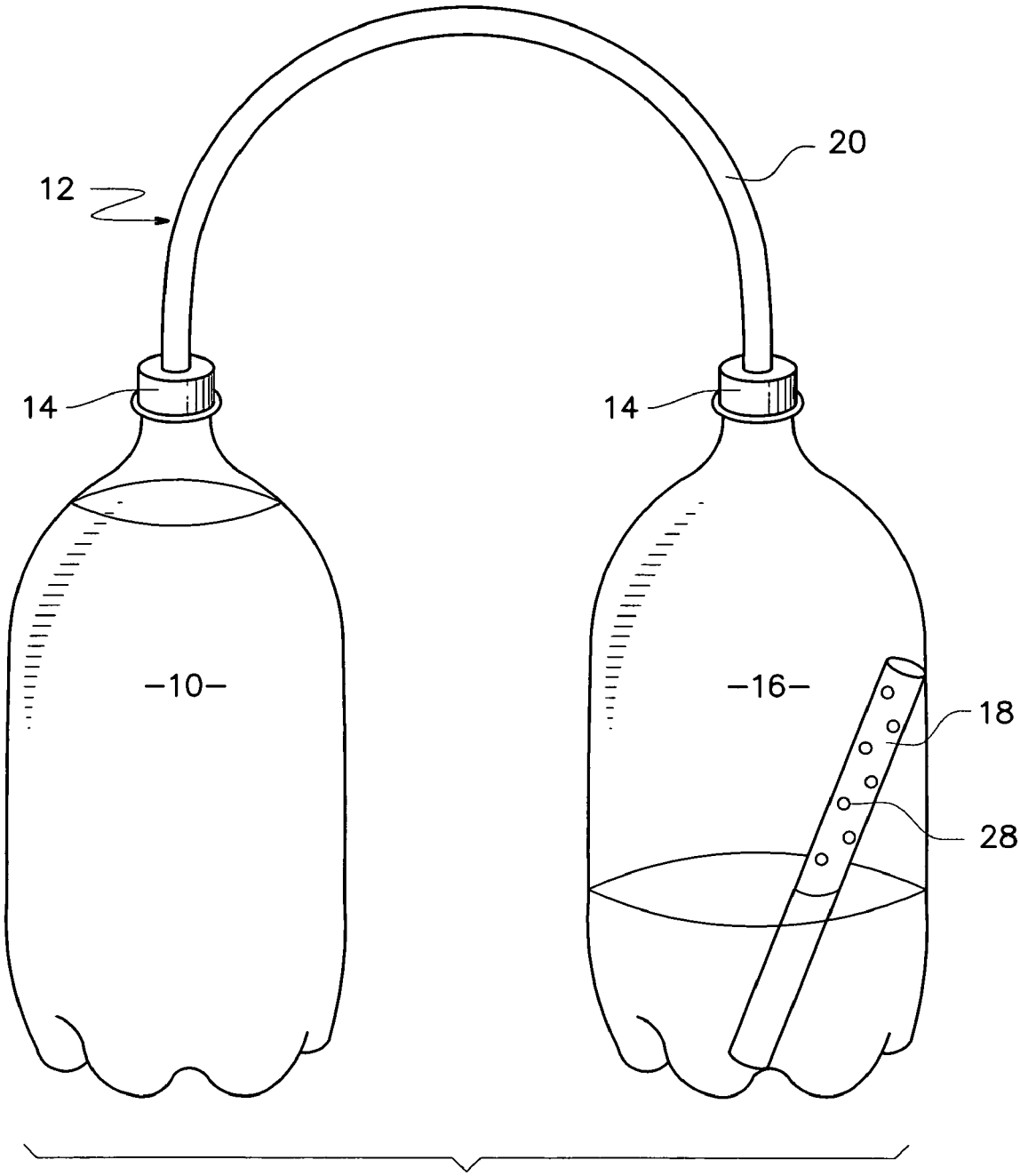
FIG. 1 shows the assembled carbonation device.

| Reference Numerals In Drawings | | | |
|---|---|---|---|
| 10 | Bottle A | 12 | Flanged Tube |
| 14 | Cap | 16 | Bottle B |
| 18 | Cylinder | 20 | Tube |
| 22 | Flange | 24 | Opening |
| 26 | Neck | 28 | Bores |

DETAILED DESCRIPTION OF THE INVENTION

Figure 2:
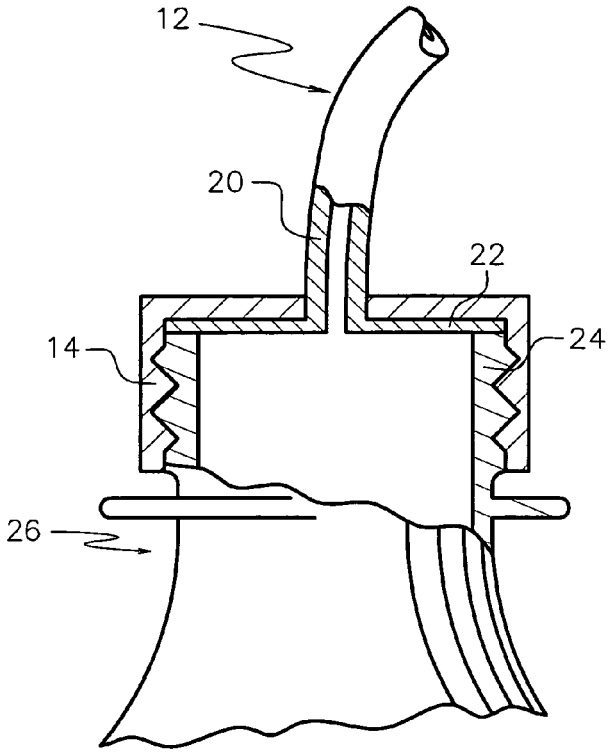
FIG. 2 is a cross section showing how the flanged tube, cap, and opening of the soda-pop bottle connect to form a gas-tight seal.
Figure 3:
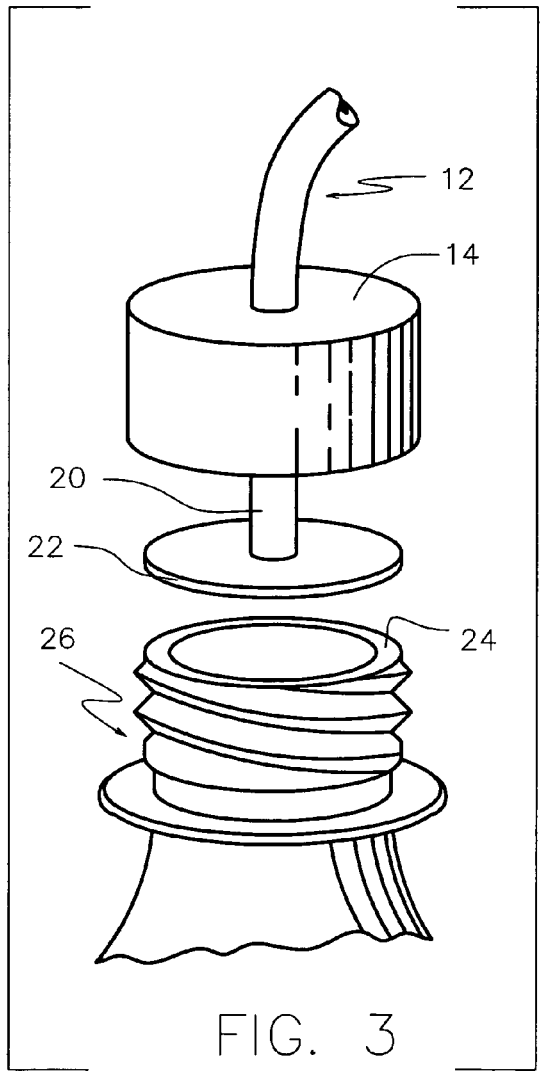
FIG. 3 shows an exploded view of the flanged tube connection.

A preferred embodiment of the present invention is shown in FIGS. 1 and 2 and 3. An existing soda-pop bottle 10, hereafter referred to as bottle A, contains a water-based liquid to be carbonated. A flanged tube 12 is held in a gas-tight manner with the opening 24 of bottle A 10 by an internally threaded cap 14 the threads of which coincide with the externally threaded neck 26 of bottle A 10. Cap 14 has an axially centered hole that allows the tube part 20 of flanged tube 12 to pass through it, while the flange part 22 is unable to pass through it. Cap 14 presses flange 22 tight against the opening 24 of bottle A 10, the said flange 22 having diameter large enough to completely cover opening 24, but small enough to fit within the inside diameter of cap 14.

Flanged tube 12 is flanged at both ends, and a second cap 14 holds the other end of flanged tube 12 in a gas-tight manner on a second existing soda-pop bottle 16 (hereafter referred to as bottle B) using an identical configuration as the connection of the first side of the flanged tube 12 with bottle A 10 described above. Namely that the other end of flanged tube 12 is held in a gas-tight manner with opening 24 of bottle B 16 by an internally threaded cap 14, the threads of which coincide with the externally threaded neck 26 of bottle B 16. Cap 14 has an axially centered hole that allows the tube part 20 of flanged tube 12 to pass through it, while the flange part 22 is unable to pass through it. Cap 14 presses flange 22 tight against the opening 24 of bottle B 16, the said flange 22 having diameter large enough to completely cover opening 24, but small enough to fit within the inside diameter of cap 14.

Flanged tube 12 can be made with flange 22 and tube 20 of a solid single material, preferably of flexible material, and of such material that flange 22 can make a gas-tight seal with opening 24 of both bottle A 10 and bottle B 12. Such material such as polyethylene must also be strong enough to withstand the pressures of carbonation. If, however, a material is chosen that does not make a gas-tight seal by itself, the addition of a rubber washer or washer of another flexible material may be used to aid in forming the gas-tight seal.

Tube 20 can be made with inside diameter small enough to keep liquid from readily passing through it, and producing small bubbles to aid in carbon dioxide dissolution. Such a diameter could be ⅛ inch for example.

Within bottle B 16 is a hollow cylinder 18 open on the top and closed on the bottom with radial bores 28. Bores 28 are situated on cylinder 18 so as to be far enough from the bottom so that liquid reactant in bottle B 16 will not enter in through bores 28 when bottle B 16 is in an upright position. Bores 28 are small enough so that solid reactant held therein does not readily escape through the bores 28. Cylinder 18 has diameter small enough to fit through opening 24 of bottle B 16. Cylinder 18 also has length suited to hold the appropriate amount of reactant to produce the correct amount of carbon dioxide.

In an alternative embodiment, if liquid reactant is held in cylinder 18, then radial bores 28 are not required. Cylinder 18 may also be marked to various levels representing to various quantities of reactant corresponding to various amounts of carbon dioxide produced.

Advantages

From the description above, a number of advantages of my carbonation device become apparent:

(a) The use of existing soda-pop bottles reduces the size, production requirements and packaging of the device. This makes the device simpler and less expensive than other carbonation devices.

(b) The use of existing soda-pop bottles allows a convenient container for storing the carbonated beverage once it is made, capping it with its original bottle cap.

(c) The use of reactants to produce carbon dioxide provides a convenient and available source for carbon dioxide.

(d) The use of two bottles keeps reactants from mixing with the liquid to be carbonated, thereby avoiding unpleasant tastes.

(e) The use of the cylinder keeps reactants from reacting before the system is sealed in a gas-tight manner.

Operation

The manner for carbonating a water-based liquid with the present device begins by placing the liquid to be carbonated into bottle A 10. One side of flanged tube 12 is fit to opening 24 of bottle A 10 and fastened in place with cap 14.

In the preferred embodiment, liquid reactant such as acetic acid (vinegar) is placed in bottle B 16. Cylinder 18 is filled with solid reactant such as sodium bicarbonate (baking soda). Some of the solid reactant is added to the liquid reactant to produce enough carbon dioxide to purge bottle B 16 of air. Cylinder 18 is then inserted through opening 24 of bottle B 16. The liquid does not reach bores 28 with bottle B 16 in an upright position. In an alternative embodiment, liquid reactant could be placed in Cylinder 18 instead, Cylinder 18 having no bores 28. In yet another alternative embodiment, Cylinder 18 can have bores 28 low enough that a few bores 28 are situated below the liquid reactant level. This will allow a small amount of reaction to occur, enough to purge bottle B 16 of air, thereby removing the need to add some of the solid reactant separately as mentioned in the preferred embodiment. With common vinegar that is 5% acetic acid by volume, the quantity of vinegar needed to produce enough carbon dioxide does not fit in a cylinder that has diameter small enough to fit through the opening 24 of bottle B 16 and length short enough to fit within the height of bottle B 16. However, the quantity of baking soda needed to react with the vinegar does fit within a cylinder that has diameter small enough to fit through the opening 24 of bottle B 16 and length short enough to fit within the height of bottle B 16.

With cylinder 18 placed in bottle B 16, the free end of flanged tube 12 is positioned on opening 24 of bottle B 16 and fastened in place with cap 14. This creates a gas-tight connection from bottle B 16 to bottle A 10.

Next, bottle B 16 is placed on its side. With cylinder 18 now on its side, the reactants are able to reach each other and the reaction begins. Carbon dioxide gas is produced and it passes through tube 20 and through the principles of Henry's Law of Dissolved Gasses, the pressure of the carbon dioxide gas sets the level of carbonation in the liquid. The pressurized system is then left for a predetermined length of time until carbonation is complete.

CONCLUSIONS, RAMIFICATIONS, AND SCOPE

Accordingly, it can be seen that the carbonation device of this invention can be made at a very low cost. The carbonation process is presented in a novel and basic manner. A convenient source of carbon dioxide is used, and unpleasant byproducts are kept from mixing with the carbonated liquid. Furthermore, the carbonation device has the additional advantages that:

it provides a carbonation device that can be simple and inexpensive to manufacture;

it provides a carbonation device that uses readily available chemical reactants to produce the carbon dioxide for carbonation;

it provides a carbonation device that keeps the byproducts of reaction from mixing with the liquid to be carbonated;

it provides a carbonation device that keeps the products of reaction from combining until a gas-tight seal is formed;

it provides a carbonation device that can carbonate water-based liquids, including water, soda-pop, punches, fruit juices, and so forth; and it provides a carbonation device that uses existing soda-pop bottles to allow a convenient familiar container for the carbonated beverage.

Although the description above contains many specificities, these should not be construed as limiting the scope of the invention but as merely providing illustrations of some of the presently preferred embodiments of this invention. For example, the tube part of the flanged tube could be extended so that it reaches into the liquid to be carbonated to facilitate the bubbling of carbon dioxide bubbles through solution; there could be an introduction of a porous membrane at the end of the flanged tube to produce finer bubbles into solution thereby increasing the gas dissolution rate; rigid tubes could be used in place of flexible ones, the flanged tube can be made of separate flange and tube parts, etc.

Thus the scope of this invention should be determined by the appended claims and their legal equivalents, rather than by the examples given.

I claim:

1. A device for preparing a carbonated beverage from a water-based liquid designed to connect two containers in a gas-tight manner keeping chemical reactants in one of the said containers from mixing with the said water-based liquid to be carbonated, while allowing carbon dioxide from the chemical reaction to dissolve in the said water-based liquid, comprising:

a. a flexible conduit for providing a pathway for said carbon dioxide to pass from the said container that houses the said chemical reaction to the other of the said containers;

b. a connecting means for fixing said conduit to said containers in a gas-tight manner comprising a flange on each end of said conduit, an internally threaded cap on each end of said conduit with axially centered hole through which the said conduit passes, said internally threaded cap engaging external threads on each of the said containers, tightening said flange to the opening of the said containers in a gas-tight manner;

c. a preventing means for hindering said chemical reactants from reacting until said conduit has made the gas-tight seal comprising a free standing hollow cylinder, open on one end and closed on the other end, into which is placed one chemical, said hollow cylinder acting as a barrier between the chemical held therein and the other chemical held in one of the said containers into which the said filled cylinder is placed said cylinder having no physical attachment to the said containers or connecting means, said cylinder having radial bores to facilitate mixing of the chemicals once either chemical passes through any of the said radial bores;

d. said containers both being of the type standardly used in the sale of soda-pop.

* * * * *